United States Patent [19]

Lindsay et al.

[11] Patent Number: 4,820,547

[45] Date of Patent: Apr. 11, 1989

[54] ACTIVATORS FOR COLLOIDAL CATALYSTS IN ELECTROLESS PLATING PROCESSES

[75] Inventors: Deborah J. Lindsay; Nathan Feldstein, both of Princeton, N.J.

[73] Assignee: Surface Technology, Inc., Princeton, N.J.

[21] Appl. No.: 211,651

[22] Filed: Jun. 27, 1988

Related U.S. Application Data

[63] Continuation of Ser. No. 41,992, Apr. 24, 1987, abandoned, which is a continuation of Ser. No. 927,456, Nov. 6, 1986, abandoned, which is a continuation of Ser. No. 422,301, Sep. 23, 1982, abandoned, which is a continuation of Ser. No. 279,788, Jul. 2, 1981, abandoned.

[51] Int. Cl.[4] ..... C23C 18/30

[52] U.S. Cl. ..... 427/97; 106/1.11; 427/98; 427/304; 427/306

[58] Field of Search ..... 427/97, 98, 304, 306; 106/1.11

[56] References Cited

U.S. PATENT DOCUMENTS

| | | | |
|---|---|---|---|
| 3,500,927 | 3/1970 | Simpson | 427/305 |
| 3,958,048 | 5/1976 | Donovan | 427/306 |
| 4,278,712 | 7/1981 | Thomann | 427/307 |
| 4,282,271 | 8/1981 | Feldstein | 427/306 |
| 4,301,190 | 11/1981 | Feldstein | 427/305 |
| 4,355,083 | 10/1982 | Feldstein | 428/621 |

*Primary Examiner*—Shrive Beck
*Assistant Examiner*—Vi Duong Dang

[57] ABSTRACT

Metallic surfaces are imparted to non-conductor substrates by an electroless plating process comprising contacting the substrate with colloidal composition comprising colloids of catalytic metals capable of electroless plating initiation and activator(s) capable of modifying and extending the useful life-time for the colloidal composition from further deterioration.

19 Claims, No Drawings

ACTIVATORS FOR COLLOIDAL CATALYSTS IN ELECTROLESS PLATING PROCESSES

Reference to prior applications: This application is a continuation of copending application Ser. No. 041,992 filed Apr. 24, 1987, now abandoned, which is a continuation of application Ser. No. 927,456 filed Nov. 6, 1986, now abandoned which is a continuation of copending application Ser. No. 422,301 filed Sept. 23, 1982, now abandoned, which is a divisional application of copending application Ser. No. 279,788 filed July 2, 1981 now abandoned.

BACKGROUND OF THE INVENTION

Electroless or autocatalytic coating of dielectric (non-conductor) substrates is a well known process finding wide utility in the preparation of such diverse articles as printed circuitry arrays (e.g., PTH), automotive trim, decorative plating, mirrors, decorative silver spray and the like. Normal electroless coating processes generally involve an initial cleaning and/or etching of the substrate by physical or chemical means as to improve the adherence of the metallic coating. In addition, the etched substrate generally provides with improved wettability toward water. The etched surface is then catalyzed or sensitized by suitable catalytic composition and processes to provide a surface capable of electroless (chemical) plating initiation.

In the prior art the catalytic treatment generally encompassed the use of precious metals (e.g., palladium). More recently, compositions and processes utilizing non-precious metals have been disclosed suitable for electroless plating of dielectrics. The following U.S. patents disclose the prior art as applied to non-precious metals as well as precious metal catalysts for electroless or chemical plating processes. These patents are included herein by reference.

U.S. Pat. Nos. 3,993,491; 3,993,799; 3,993,801; 3,993,848; 3,958,048; 4,048,354; 4,082,899; 4,087,586; 4,131,699; 4,123,832; 4,136,216; 4,150,171; 4,151,311; 4,167,596; 4,180,600; 4,181,759; 4,181,760; 4,220,678; 4,224,178; 3,011,920; 4,273,804; 4,265,942; 4,261,747; 4,259,087; 4,259,376; 4,233,344; Also, British Pat. No. 1,426,462 is included by reference. The following U.S. applications also reflect the state of the art and they are included herein by reference:

U.S. Ser. No. 052,857 now U.S. Pat. No. 4,278,712; U.S. Ser. No. 056,622 now U.S. Pat. No. 4,282,271; U.S. Ser. No. 061,484 now U.S. Pat. No. 4,301,190; U.S. Ser. No. 106,916 now U.S. Pat. No. 4,355,083; and U.S. Ser. No. 204,495 now abandoned. The prior art demonstrates that in the utilization of colloidal compositions, particularly those bearing non-precious metals, elemental state, compounds, or alloys bearing the non-precious metals of catalytic metals have been utilized directly or indirectly for the catalytic sites capable of electroless plating initiation.

In some of the applications disclosed above, particularly in the electroless plating for printed circuitry (e.g., PTH processing), there appears to be a change in surface charge especially after certain of the etching steps (e.g., ammonium persulfate). Such modification in a surface charge may adversely affect the adsorption or absorption of the catalyst (or sensitizer) onto the dielectric substrate or any other substrate and consequently affect its ability for electroless (chemical) plating initiation and as well as the resulting uniformity of plating.

Incomplete electroless plating can often lead to skip plating. Such consequences cannot be afforded in commercial practices. Accordingly, at times it is highly desirable to provide with a manner by which a simple and inexpensive modification may be adapted compatible with the process and material, thereby insuring increased catalytic adsorption through the inclusion of a "prewetting" step.

In experimentation with the above prior art, particularly those colloidal systems used in the preparation of non-conductors, or printed circuitry type substrates, it has been noted that at times a certain failure mechanism takes place which shortens the lifetime of the colloidal catalytic composition. For instance, in examining some of the enabling examples in U.S. Pat. No. 3,958,048 it is also noted that the initial dispersion disappears within several hours and becomes a true solution. By contrast, some of the examples shown in U.S. Pat. No. 4,265,942 appear to deteriorate with time through the formation of brown dispersion and ultimate lead to green product which has a tendency of settling. Though the exact mechanism by which this deterioration takes place is not well understood, it is highly desirable to provide means whereby the lifetime for such colloidal dispersion may be extended through the incorporation of special additives (i.e., activator).

SUMMARY OF THE INVENTION

It is the principle object of the present invention to provide an effective and economical process(es) for the preparation and metallization of non-conductor substrate(s) for electroless (chemical) plating. In its particular application, the particular object of the present invention is to provide means by which the effective life-time for the colloidal dispersion is increased through the incorporation of an activator.

DETAILED DESCRIPTION OF THE INVENTION

The process of the present invention is applicable to metallic plating on a wide variety of dielectric (non-conductor) substrates, printed circuitry substrates, as well as semiconductors and metals. Normally, substrates to be plated will be cleaned and/or etched prior to plating in order to improve the adherence of the metallic coating. The present invention is an improvement on the processes disclosed above (references on page 2), which are included herein by reference.

In general, it has now been found that the incorporation of activator(s) into the colloidal dispersions appears to extend the useful lifetime for such compositions. While I do not wish to be bound by theory, it is believed that useful activators in the present invention are reducing agents which are capable of reducing the metal ions (e.g., $Cu^{+2} \rightarrow Cu^{\circ}$ or $Cu^{+2} \rightarrow Cu^{+1}$) which are present at the colloidal interface due to air oxidation and are probably part of an oxide or an hydrated oxide. In the case of colloidal copper compositions, useful activators appear to be materials which can reduce copper ions (copper$^{+2}$ or copper$^{+1}$) to a lower oxidation state. It is believed that when air oxidation takes place resulting in "passivation" of the colloid surface, the presence of the activator assists in the reduction of the oxidized copper surface and transforms it back to an active catalytic state. It should be recognized that activators in the present invention are not necessarily antioxidants for antioxidants exclusively react sacrificially with oxygen.

The present activators must provide the reductive chemistry with respect to the metal and metal ions of which the colloid is made up or formed with aging.

Typical activators may be selected from hydrazine and its derivatives, dimethylamine borane and its derivatives, and other similar reducing agents. The reducing agents may also include solid materials such as zinc dust and ionic reducing agents (e.g., $Fe^{+2}$). Though the incorporation of activator is preferably made after the colloid nucleation, it is possible to include the activator prior to the colloid nucleation.

Though the present invention is aimed preferably at non-precious metal, the concept of the present invention may be equally applicable to noble metal colloidal dispersions. In selecting a specific activator for a specific metal based colloidal dispersion, it is important to determine by simple experimentation the effective concentration that is required, for it has been observed that at times too little concentration may be ineffective, whereas too much may suppress the catalytic phenomena.

Moreover, in the selection and utilization of a specific activator, the conditions selected must be such that the activator is in an active state. For instance, certain reducing agents are known to be inactive in acidic pH while being active at alkaline pH. Hence it should also be recognized that if the colloid is nucleated under the conditions where a specific activator is inactive, such activator may be incorporated prior to the colloid nucleation, rather than subsequent to the colloid nucleation. Under such condition the activator will remain in the dispersion, and will not be consumed. After a pH adjustment of the colloidal dispersion the activator will be converted into an active state and provide its beneficial effect(s).

In general, the electroless or chemical coating process of the present invention comprises the following preferred sequence:

1. Cleaning and/or etching of the substrate, with preferred rinsing thereafter.

2. Optionally, contacting the substrate with a composition comprising an adsorption modifier, thereby providing improved adsorption and/or absorption of the catalytic (or sensitizer) composition thereafter, and rinsing.

3. Contacting the dielectric substrate with a catalytic composition, preferably colloids of non-precious catalytic metals, selected from a group consisting of copper, nickel, cobalt and iron and mixtures thereof, and furthermore wherein this catalytic metal may be in any of several oxidation states, elemental state or part of an alloy or compounds along with an activator, and thereafter preferably rinsing with a suitable solvent.

4. Immersion of the treated substrate into a compatible electroless (or chemical) plating bath for the desired metallic build-up.

It is noted that at times it may also be preferable to interpose an intermediate step prior to the electroless metal deposition and after the contacting of the substrate with the catalytic composition. Such step may be referred to as activation or acceleration, as has been noted in the patents and articles referred to above. The use of an activator (or accelerator) composition as a separate step may be necessitated either for reducing the induction time in the electroless step and/or for removing weakly adsorbed catalytic component to insure improved overall metal adhesion.

The following examples are illustrative of the present invention and are not to be taken in limitation thereof.

Though the present invention is primarily aimed at the metallization of non-conductor substrates, it is recognized that adaptation of the present process and composition may be applicable to metallic and semiconductor substrates as well. Accordingly, the extension of the present examples onto metallic, printed circuitry composites, and semiconductor type substrates falls within the spirit of this invention. The incorporation of the activator (e.g., hydrazine) appears to lead to the formation of a "red" product which is dispersed through the composition and still maintains good activity in the electroless plating process. The red phase may be copper or cuprous oxide.

EXAMPLE 1

An ABS substrate was etched for 20 minutes in a chromic acid etchant at 75° C. It was rinsed in water.

The etched ABS substrate was the immersed in a cationic prewet composition, 5% Experimental Polymer XD 30267.00 (product of The Dow Chemical Company) for 3 minutes.

After rinsing, it was contacted (3 minutes) with a colloidal composition comprising the reaction admixture of

| | |
|---|---|
| 8.89 mM | $CuCl_2H_2O$ |
| 11.25 mM | $Sn(BF_4)_2$ |
| 2.22 g/l | Gelatin |
| 55.60 mM | $NaBH_4$ |
| 56.02 mM | NaOH |
| 2.00 mM | $Na_3PO_4$ |
| 49.40 mM | $N_2H_4$ |
| pH = 9 | |

The phosphate and hydrazine were added subsequent to the colloid nucleation and the nucleation took place at 80° C.

After rinsing, the treated ABS substrate was immersed in the commercial copper electroless plating bath Cuposit CP-74 (product of Shipley Company) at 47° C. Complete coverage took place within 1 minute.

The above colloidal composition (without replenishment) catalyzed plating on ABS substrates for a total of 27 days before decomposition. A colloidal composition comprising the same components except for the sodium phosphate and hydrazine plated for 8 days. It is noted that the beneficial effects associated with the hydrazine activator are not limited to the presence of phosphate. The phosphate, however, helps in providing an improved dispersion.

EXAMPLE 2

The procedure of Example 1 was followed, except the colloidal composition comprised:

| | |
|---|---|
| 8.89 mM | $CuCl_2H_2O$ |
| 11.25 mM | $Sn(BF_4)_2$ |
| 2.22 g/l | Gelatin |
| 5.60 mM | $NaBH_4$ |
| 6.02 mM | NaOH |
| 52.2 mM | $(CH_3)_2NHBH_3$ |
| pH = 8 | |

The above composition plated for at least 14 days. The colloidal composition without dimethylamine borane plated for 8 days. The above colloids were nucleated in a fashion similar to that taught in U.S. Pat. Nos. 3,950,048, 3,993,799 and 4,265,942. The above results are based upon evaluation of 900 ml volumes.

It is also noted that the preferred colloidal dispersion comprises of colloids having a particle size range of 10 to 200 Å with preference toward the lower end of the scale.

It has also been observed that the lifetime for the colloidal composition appears to be volume-dependent. In general, the lifetime for the colloidal dispersion is increased with increased volumes.

I claim:

1. A process for the electroless plating of a non-conductor substrate comprising the steps of:

(a) contacting said substrate with an aqueous colloidal dispersion, said dispersion comprising a non-noble catalytic metal for the electroless plating initiation, a colloidal stabilizer and an activator, said activator being a reducing agent capable of reducing metallic ions of said catalytic metal and further wherein said activator is incorporated into said colloidal dispersion subsequent to the step of colloidal nucleation thereby extending the useful life for said colloidal dispersion, and thereafter (b) contacting the treated substrate with a compatible electroless plating bath to deposit a metallic layer thereof.

2. The process according to claim 1 wherein said catalytic metal is copper.

3. The process according to claim 1 wherein said activator is hydrazine or a derivative of hydrazine.

4. The process according to claim 1 wherein said electroless plating is copper.

5. The process according to claim 1 wherein said colloidal dispersion is used at pH 7 and above.

6. The process according to claim 1 further containing the step of prewetting, said step being prior to the step of contacting the substrate with said colloidal dispersion.

7. The process according to claim 6 wherein said prewetting step comprises the contacting of said substrate with a composition comprising a member selected from the group consisting of surfactant, hydrous oxide sol, complexing agent, and a chelating agent.

8. The process according to claim 1 wherein said substrate is a printed circuitry type substrate.

9. The process according to claim 8 wherein said electroless plating bath is copper and is operating above room temperature.

10. The process according to claim 1 wherein said printed circuitry type substrate contains thru-holes.

11. The process according to claim 1 wherein said colloidal dispersion comprises colloids in the size range of 10 to 200 Angstroms.

12. The process according to claim 1 wherein said colloidal stabilizer is a secondary colloid.

13. The process according to claim 1 wherein said colloidal stabilizer is gelatin.

14. A process for the electroless plating of a non-conductor substrate comprising (a) contacting said substrate with a stable colloidal dispersion, said dispersion comprising a colloid stabilizer, a colloid of a non-noble metal for electroless plating initiation, said metal being in a reduced oxidation state, and an activator, said activator being hydrazine or derivatives thereof, a reducing agent capable of reducing metal ions of said non-noble metal to a lower oxidation state thereby extending the useful life-time for said colloidal dispersion, said activator being added subsequent to the colloid nucleation process, and (b) contacting the treated substrate with a compatible electroless plating bath to deposit a metallic layer thereof.

15. The process according to claim 14 wherein said non-noble metal is copper.

16. A method for extending the useful lifetime of an aqueous colloidal dispersion useful in the catalytic treatment of substrates prior to electroless plating, said method encompassing the step of incorporating an activator along with non-noble colloids of a catalytic metal capable of electroless plating initiation, said step being carried forth subsequent to the nucleation of said non-noble colloids, and further wherein said activator is a reducing agent capable of reducing metallic ions of said catalytic metal.

17. The method according to claim 16 wherein said catalytic metal is copper.

18. The method according to claim 16 wherein said electroless plating is copper.

19. The method according to claim 16 wherein said colloidal dispersion is used at an approximate pH value of 7.

* * * * *